US006094774A

United States Patent [19]

Larsen et al.

[11] Patent Number: 6,094,774

[45] Date of Patent: Aug. 1, 2000

[54] SILENCER FOR A SUCTION CLEANER

[75] Inventors: Peter Nøhr Larsen, Copenhagen; Thomas Dam Jensen, Helsinger, both of Denmark

[73] Assignee: Nilfisk A/S, Brondby, Denmark

[21] Appl. No.: 09/051,425

[22] PCT Filed: Oct. 9, 1996

[86] PCT No.: PCT/DK96/00425

§ 371 Date: Sep. 8, 1998

§ 102(e) Date: Sep. 8, 1998

[87] PCT Pub. No.: WO97/13443

PCT Pub. Date: Apr. 17, 1997

[30] Foreign Application Priority Data

Oct. 10, 1995 [DK] Denmark ..... 1138/95

[51] Int. Cl.[7] ..... A47L 9/00

[52] U.S. Cl. ..... 15/326; 96/382; 181/231; 417/312

[58] Field of Search ..... 15/326; 417/312; 181/231; 96/382

[56] References Cited

U.S. PATENT DOCUMENTS

| | | | |
|---|---|---|---|
| 2,884,185 | 4/1959 | Dolan | 15/326 X |
| 4,356,591 | 11/1982 | Lude | 15/326 |
| 5,159,738 | 11/1992 | Sunagawa et al. | 15/326 |
| 5,293,664 | 3/1994 | Lim et al. | 15/326 |
| 5,720,074 | 2/1998 | Lee | 15/326 |
| 5,894,629 | 4/1999 | Kim | 125/326 |

FOREIGN PATENT DOCUMENTS

| | | | |
|---|---|---|---|
| 453296 | 10/1991 | European Pat. Off. | 15/326 |
| 641371 | 1/1937 | Germany . | |
| 3402603 | 8/1985 | Germany . | |
| 4100858 | 9/1993 | Germany . | |
| 2062451 | 5/1981 | United Kingdom . | |

*Primary Examiner*—Chris K. Moore
*Attorney, Agent, or Firm*—Ladas & Parry

[57] ABSTRACT

A suction cleaner comprising a motor which operates a blower in such a manner that the blower blows a flow of air out into a motor chamber that delimits a volume which extends at least radially around the motor, and then out through outlet openings arranged in said motor chamber, and wherein the motor chamber is provided with a silencer element made of a silencing material, such as foamed plastics, said silencer element enclosing the motor radially and forming a silencing chamber around the same, and wherein the silencer element is provided with flow passages which substantially constitute the flow connection from said silencing chamber to the outflow openings in the motor chamber. The fact that the flow passages in the silencer element according to the invention extend axially along the motor in substantially the entire length thereof provides an optimum silencing effect.

16 Claims, 3 Drawing Sheets

SILENCER FOR A SUCTION CLEANER

FIELD OF INVENTION

The present invention relates to a suction cleaner of the type described in the introductory part of claim 1, comprising a motor which operates a blower in such a manner that the blower blows a flow of air out into a motor chamber that delimits a volume which extends at least radially around the motor, and subsequently out through outflow openings arranged in the motor chamber, and wherein a silencer element is provided in the motor chamber, made of a silencing material that encloses the motor radially and forms a silencing chamber around the same, and wherein the silencer element is provided with flow passages which constitute the flow connection from said silencing chamber to the outflow openings in the motor chamber.

BACKGROUND OF INVENTION

DE 34 02 603 A1 teaches such suction cleaner in the form of a vacuum cleaner wherein a jacket of a sound absorbing foam material is provided around the motor, wherein flow openings are provided that extend radially sideways relative to the motor. Therefore the outside of the silencing jacket is provided with flow passages that extend along the inside of the motor housing and which convey the flow of air axially along the outside of the jacket and the blower and to an outflow opening arranged at the blower with a view to concentrating the flow of air from the vacuum cleaner.

GB A 2 062 451 also teaches a suction cleaner in the form of a vacuum cleaner and having around the motor a jacket of a silencing material. Outside this jacket a further jacket is arranged which is spaced from the innermost jacket by means of studs whereby a number of interconnected flow paths are provided which extend partially axially relative to the rotational axis of the motor. This prior art suction cleaner is associated with the problem that the flow passages which are covered by the jackets and the activated studs give rise to a fairly turbulent flow pattern with ensuing large friction losses.

The vacuum cleaner according to DE 34 02 603 A1 distinguishes itself over other known types by the jacket enclosing the motor being of a silencing material, such as foamed plastics, whereby the jacket is self-supporting and does not have to be braced as is the case with other types of vacuum cleaners, such as e.g. the vacuum cleaner according to U.S. Pat. No. 5,293,664 or DE C 64 13 71 wherein the jacket is of a silencing material applied as a surface coating on a relatively rigid jacket-shaped element in combination with the radially arranged flow passages resulting in a relatively small friction loss in the flow. By the substantially self-supporting jacket according to DE 34 02 603 A1 a reduction of the sound transmission through rigid elements in the structure of the vacuum cleaner is further obtained while simultaneously providing a silencing jacket which is comparatively simple and inexpensive to manufacture.

SUMMARY OF INVENTION

It is the object of the present invention to provide a suction cleaner which, ceteris paribus, exhibits improved silencing and flow properties compared to the known type described above and obtainable with the prior art according to DE 34 02 603 A1, and which is also more simple to manufacture.

This is obtained with a suction cleaner of the type claimed or by use of the silencer according to the invention, since hereby the flow passages in the silencer element extend substantially axially along the motor in their entire length and at the same time the walls which separate the individual flow passages ensure a suitable bracing of the silencer element without ensuing large flow losses due to a turbulent flow pattern.

This allows for smaller dimensions of the motor housing in the radial direction and prevents the air flow from travelling along the inside of the motor housing, which would in itself contribute to the transmission of noise to the outside of the motor housing.

Moreover the invention provides the possibility of extending the flow passages considerably in the silencer element whereby improved silencing is obtained, since long passages provide improved silencing compared to the corresponding short ones. In particular when the flow passages are in connection with a silencing chamber, as is the case with the present invention, the silencing chamber in combination with the flow passages will act as a resonant system where it will be difficult for frequencies above a limit frequency to be transmitted. The resonant system may be described as a mass/spring system where the air in the silencing chamber constitutes the spring stiffness, and wherein the air in the flow passages constitute the mass. With a view to optimizing the silencing properties for this purpose, the limit frequency must be as low as possible, which is obtained with long, narrow passages, ceteris paribus.

An alternative way of obtaining a low limit frequency is by providing a comparatively large-volume silencing chamber which is exactly what is obtained with a construction according to the invention, since the axial passages at the inside of the motor chamber are rendered superfluous whereby a given installation space in the radial direction leaves more room for the silencing chamber.

When the silencer element is, in accordance with the invention, provided with at least two axially extending flow passages which are separated from each other by partition walls in the silencer element intended therefor, it is possible to maintain the cross sectional dimensions of the flow passages relatively constant whereby the pressure loss in the passage is maintained at a relatively low value. However, it is obvious that the more separate flow passages, the stronger the bracing effect of the partition walls. However, in practice, a substantially increased rigidity will not be obtained when the number of separate flow passages exceeds twelve whereby a maximum for the number of walls is established.

Conveniently the flow passages have a dimension in the radial direction of more than 2 mm and preferably more than 4 mm whereby the risk of collapse of the passage as a consequence of the pressure in the silencing chamber is reduced. A radial dimension of more than 10 mm will reduce the silencing considerably in the flow conditions normally prevailing in a normal suction cleaner. Preferably, 4 mm to 8 mm will be an optimum dimensional range for this purpose.

The design of the silencer with a silencing chamber which extends radially outwards and along the side of the blower which faces towards the motor and at least past the inlet opening on the axially extending flow passages in the silencer element provides the effect that the flow passages may be comparatively long with an ensuing improved silencing effect. Moreover, the silencer is readily made of a piece of material, e.g. foamed plastics, e.g. by water-jet cutting, since there is no need for transverse passages in the silencer for conveying the air flow radially outwards to the flow passages.

In particular, the invention lends itself for use in connection with suction cleaners where the motor chamber has a first end surface which is in abutment with the suction side of the blower and which is provided with flow openings that connect the dust receiving chamber to the suction side on the blower, and a second end surface which faces away from the first end surface and supports the motor, and wherein the flow openings are arranged in the second end surface. Thus, in this suction cleaner the outside of the second end surface may be provided with a further silencer element which further silencer element delimits a further silencing chamber which is in flow connection with the axially extending flow passages in the silencer element via the outflow openings in the second end surface. Hereby optimized silencing is obtained with minimum requirements to space since the further silencer element will absorb sound caused by the air flow as well as sound caused by motor vibrations at the second end surface.

In this connection it is particularly advantageous if the further silencer element covers at least that portion of the second end surface which is radially arranged within the outflow openings therein. Hereby the entire motor is substantially surrounded by sound absorbing material which will obviously provide optimum silencing.

The further sound absorbing element may either be provided with silencing flow passages or be made of a filtering, air-permeable material.

BRIEF DESCRIPTION OF DRAWINGS

The invention will now be described in further detail and in accordance with a preferred embodiment with reference to the drawings wherein.

DETAILED DESCRIPTION

Figure 1:
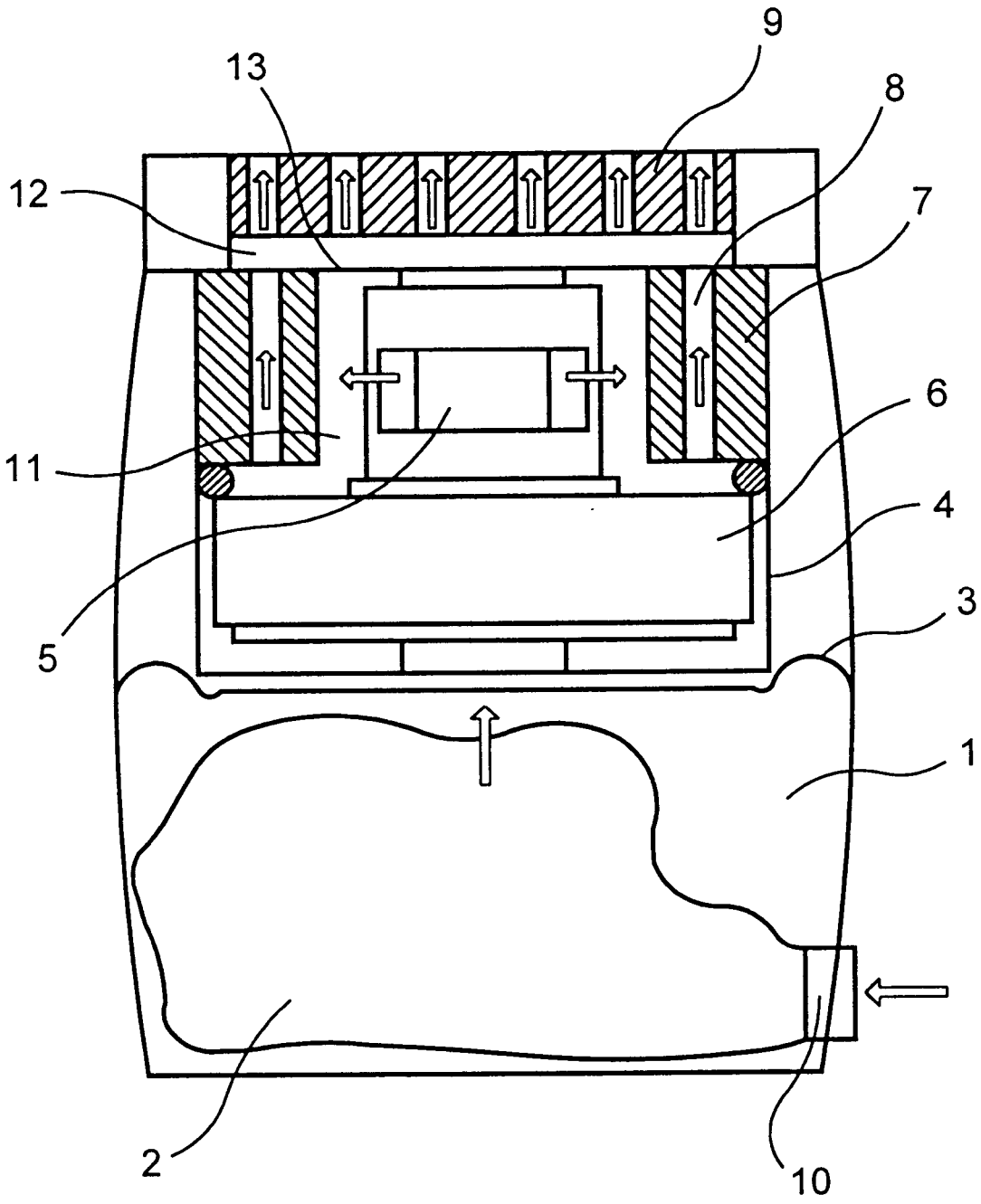
FIG. 1 is a schematic view of the construction of a suction cleaner according to the invention in the form of a vacuum cleaner.

Thus FIG. 1 illustrates the constructive principle of a vacuum cleaner according to the invention wherein only the most important elements have been included. As shown, the vacuum cleaner is divided into two main chambers. At the bottom there is a dust chamber 1 with a dust bag 2 and a main filter 3. At the top a motor chamber 4 is provided which contains the motor 5 of the vacuum cleaner as well as a blower 6 operated by the motor 5.

According to the invention a silencer element 7 with flow passages 8 is provided around the motor 5.

Moreover the vacuum cleaner is provided at the top with a unit 9 which may consist either of a filter or a further silencing unit.

Thus, the vacuum cleaner shown in FIG. 1 is operated by the motor 5 driving the blower 6 whereby air is drawn from the inlet opening 10 of the vacuum cleaner and into the dust bag 2 and through the latter and into the dust chamber 1 and through the main filter 3. Then the air flows in a known manner through not shown openings in the motor chamber 4 and into the blower 6 which in a conventional manner subsequently blows the air flow up around the armature of the motor 5 which is an electromotor in this case, out through the sides of the motor 5 whereby the air flows out into a silencing chamber 11 around the motor 5. According to the invention the air then flows through the flow passages 8 in the silencer element 7, substantially parallel with the rotational axis of the motors. From here the air flows upwards into a second chamber 12 which is delimited by inter alia a cover plate 13 that delimits the motor chamber 4, and the unit 9 which may consist of a filter or a silencer element.

Since the flow passages 8 extend axially along the rotational axis of the motor it is possible, in the given constructional conditions most often prevailing in vacuum cleaner constructions, to construct fairly long flow passages 8 compared to the alternative situation where they are to extend radially sideways.

As will appear from FIG. 1 it is possible according to the invention to enclose the motor 5 on all sides except the side facing towards the blower 6, with sound absorbing material in the form of the silencer 7 and the silencer or filter unit 9. In the given constructional conditions, optimum silencing properties are provided, ceteris paribus.

Figure 2:
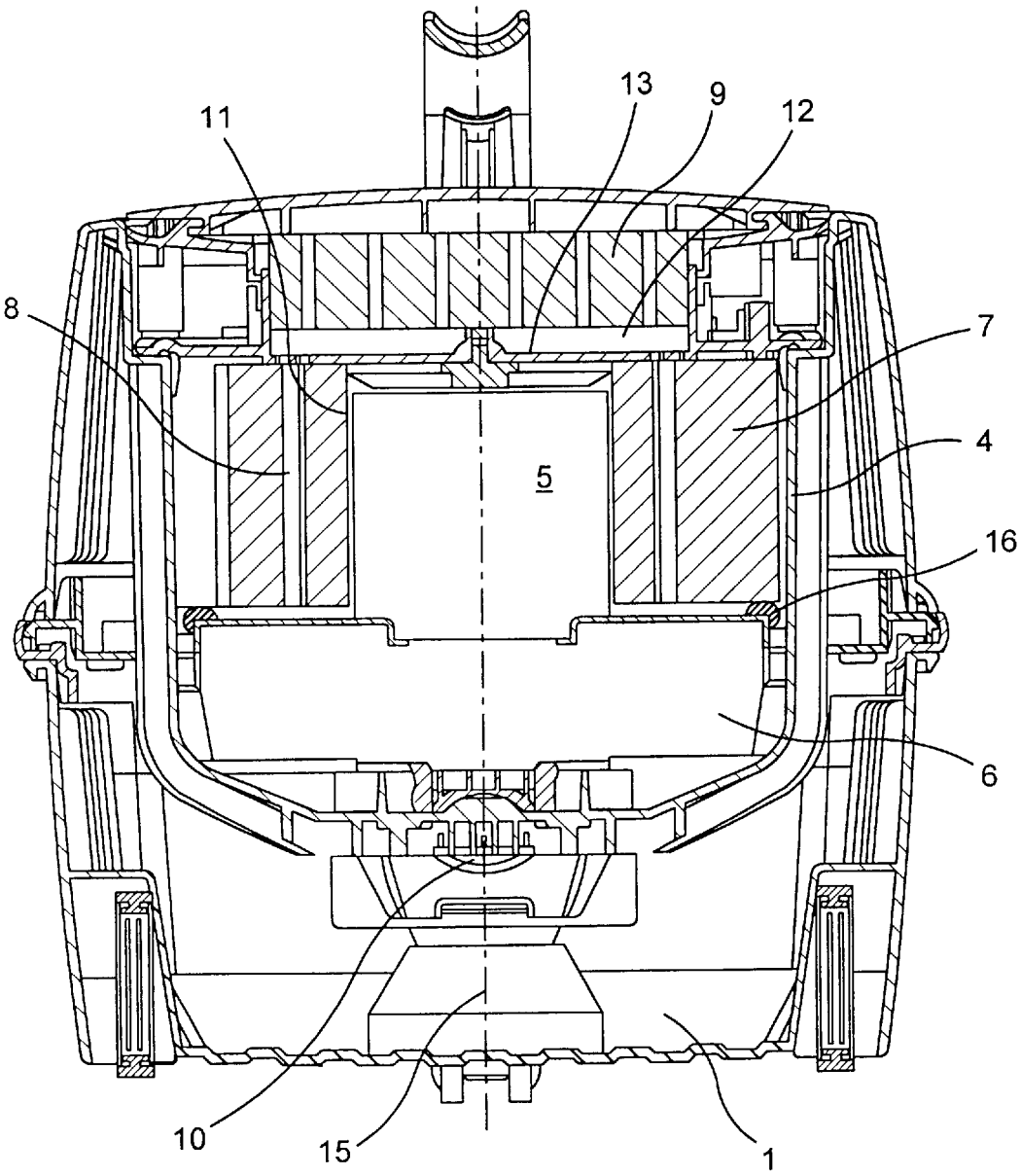
FIG. 2 is a sectional view through a vacuum cleaner according to the invention.

Reference is now made to FIG. 2 which illustrates a preferred embodiment of a vacuum cleaner according to the invention, but not illustrating the dust bag or main filter shown in FIG. 1. Herein, however, the inlet opening 10 is shown being in flow connection between the dust chamber 1 and the blower 6. FIG. 2 being a sectional view through a preferred embodiment of a vacuum cleaner according to the invention, it will appear how the motor 5 which is an electromotor is constructed with an armature that operates one or more blade wheels on the blower 6. Thus, in a conventional manner the blower 6 blows the filtered flow of air upwards past the armature on the electromotor 5 and out through its sides to the silencing chamber 11 around the motor 5. The silencing chamber 11 is delimited according to the invention by a silencer element 7 provided with passages 8 which extend substantially parallel with the rotational axis 15 on the armature of the motor 5. A flow connection has been established between the silencing chamber 11, and the flow passages 8 in the silencer element 7, along the top surface of the blower 6, by the silencer being spaced from the blower 6 by means of an annularly extending spacer ring 16. Then the air flow flows through the passages 8 and up into another silencing chamber 12 through openings in the end plate 13 which closes the motor chamber 4. Then the air flow flows out through the unit 9 which may either consist of a filter element or a further silencer element which will be described below.

Thus, according to a preferred embodiment of the invention, the unit 9 may be interchangeable so as to allow one and the same vacuum cleaner model to comprise either a further filtering or a further simple silencing element. Hereby the vacuum cleaner may be adapted for various purposes, and from a production point of view it is simple to manufacture several different types simply by changing the unit 9.

Figure 3:
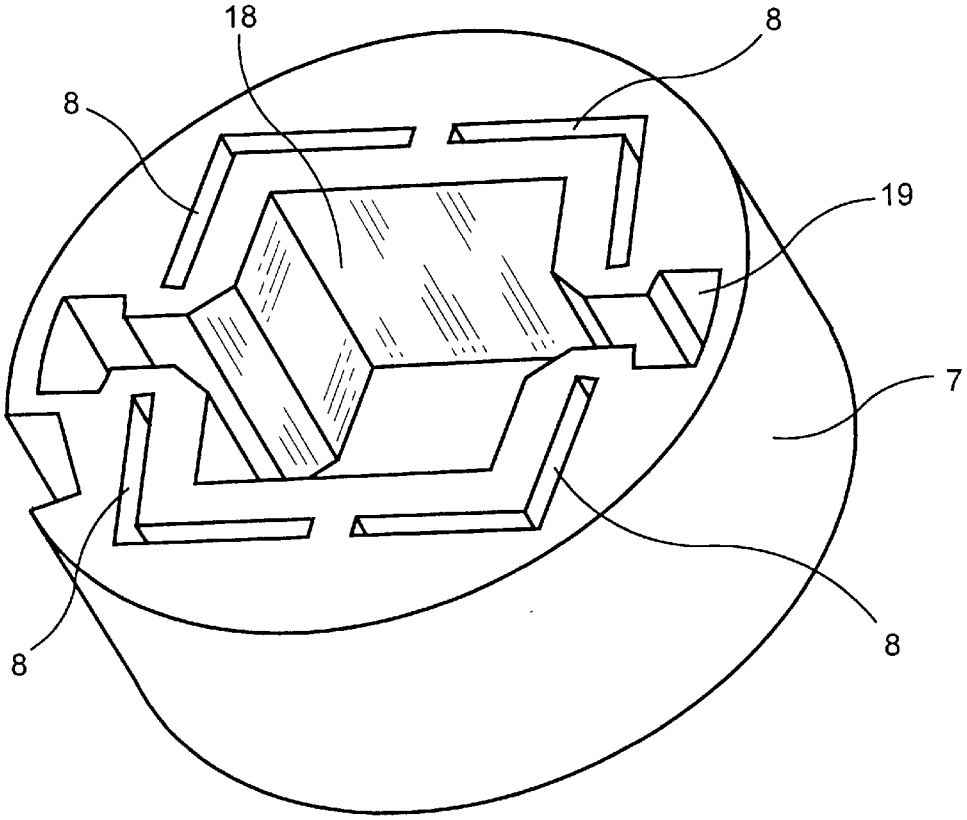
FIG. 3 is a perspective view illustrating a silencer element according to the invention for the vacuum cleaner according to FIG. 2.

Now reference is made to FIG. 3 which illustrates a silencer element according to the invention wherein flow passages 8 are provided which extend through the entire thickness of the silencer element 7. Thus, it will appear how the silencer element 7 may be manufactured in a simple manner from a sheet of starting material e.g. by water-jet cutting and other processes. Provided the silencer element 7 is made of a foamed plastics material, such water-jet cutting will leave exactly such surface on the silencer element 7 that exhibits optimum silencing properties.

As will appear from FIG. 3, the flow passages 8 have a cross section which is V-shaped. Ceteris paribus, this allows the flow passages 8 to substantially maintain their cross sectional area independently of the internal pressure which may prevail in the central opening 18 in the silencer element 7. This will mean that a pressure in the central opening 18 which will contrive to close the flow passages 8 will cause a pull in the material that delimits the flow passages 8 relative to the central opening 18, with an ensuing high degree of resistance to deformation. By imparting to the passages a V-shaped cross section in this manner, or optionally a curved cross section or the like, the flow passages 8 may be made to be relatively wide without the ensuing risk of collapse during use.

Moreover, the silencer element 7 is provided with longitudinally extending grooves 19 which permit protruding elements from the motor 5 according to FIG. 2 to protrude into the silencer element 7. The protruding portions from the motor 5 may e.g. be the coals for the commutator of the motor 5. Hereby it is possible to position the silencer element comparatively close to the motor 5 as shown in FIG. 2.

Figure 4:
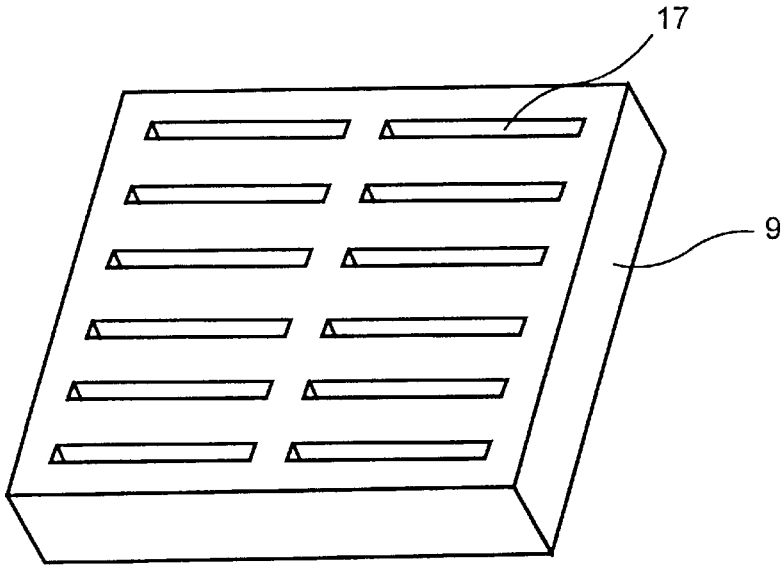
FIG. 4 illustrates an alternative silencer element for the vacuum cleaner according to FIG. 2.

Finally, FIG. 4 illustrates one embodiment of the unit 9 which is shown in FIG. 2 wherein the unit 9 is in the form of an actual sound absorbing element with silencing passages 17 extending through the unit 9. Hereby a further resonant system is provided which consists of the silencing chamber 12 as shown in FIG. 2 along with the flow passages 17 shown in FIG. 4.

As will appear, the silencing unit 9 according to FIG. 4 may thus also be made in a simple cutting process of a sheet starting material which means that this element, too, is extremely easy to manufacture.

What is claimed is:

1. A suction cleaner comprising:

a motor having a rotational axis, a blower having a suction side and a blower side, a motor chamber having outflow openings, a silencer element made of a silencing material, said silencer element being provided with flow passages, said motor chamber delimiting a volume which extends at least radially around the motor and the silencer element, said silencer element enclosing the motor radially, thereby forming a silencing chamber around the motor, said flow passages substantially constituting a flow connection from the silencing chamber to the outflow openings in the motor chamber, said motor operating the blower in such a manner that the blower blows a flow of air into the silencer chamber and subsequently through the flow passages and thereafter out through the outflow openings in the motor chamber, wherein the flow passages in the silencer element extend axially along the rotational axis of the motor in substantially their entire length, and wherein the flow passages in the silencer element comprise at least two separate axially extending flow passages which are separated from each other by partition walls.

2. A suction cleaner according to claim 1, wherein the silencer element comprises fewer than twelve separate flow passages.

3. A suction cleaner according to claim 1, wherein the dimensions of the flow passages in the radial direction are larger than 2 mm and smaller than 10 mm.

4. A suction cleaner according to claim 3, wherein the dimensions of the flow passage in the radial direction are within a range of 4 mm to 8 mm.

5. A suction cleaner according to claim 1, wherein the silencer element has a lower surface comprising inlet openings for the axially extending flow passages, the blower side of the blower facing towards the motor and the lower surface of the silencer element, and wherein the silencing chamber extends radially outwards between blower side of the blower and the lower surface of the silencer element and at least past the inlet openings for the axially extending flow passages in the silencer element.

6. A suction cleaner according to claim 1, wherein the motor chamber has a first end plate which is in abutment with the suction side of the blower and which is provided with inflow openings that connect a dust receiving chamber to the suction side of the blower, and a second end plate which faces away from the first end plate and supports the motor, wherein the outflow openings are arranged in the second end plate, and wherein the side of the second end plate which faces away from the motor is provided with a further silencer element, which further silencer element delimits a further silencing chamber between the second end plate and the further silencer element, and which further silencing chamber is in flow connection with the axially extending flow passages in the silencer element.

7. A suction cleaner according to claim 6, wherein the further silencer element covers the outflow openings in the second end plate and the portion of the second end plate which is radially inside of the outflow openings.

8. A suction cleaner according to claim 7, wherein the further silencer element is constituted of a filter.

9. A suction cleaner according to claim 6, wherein the further silencer element has flow passages extending axially, with respect to the axis of the motor, from the further silencing chamber to the surroundings of the suction cleaner.

10. A suction cleaner according to claim 9, wherein the flow passages which extend from the further silencing chamber to the surroundings have a minimum dimension in a radial direction which is larger than 2 mm and smaller than 10 mm.

11. A suction cleaner according to claim 10, wherein the minimum dimension of the further silencing chamber is within a range of 4 mm to 8 mm.

12. A silencer element for a suction cleaner, which silencer element is made of a sound absorbing material, the silencer element comprising:

first and second sides arranged opposite each other, a central opening having an axis, the opening extending between said first and second sides, the opening being adapted for receiving a motor of a suction cleaner, and a number of flow passages, wherein the silencer element has at least two axially extending flow passages which are separated from each other by partition walls in the silencer element, and wherein the flow passages are substantially straight and extend in substantially in the same direction as the axis of the central opening.

13. A suction cleaner comprising:

a motor chamber having outflow openings;

a motor in the motor chamber, said motor having an axis;

a blower that blows air into the motor chamber; and silencer means surrounding a periphery of the motor for providing a plurality of flow passages through which air blown into the motor chamber passes from a position near the bottom of the motor to a position atop the motor in a direction parallel to the axis, said silencer means comprising a unitary piece of sound absorbing material formed with the flow passages therein such that each of the flow passages is partitioned from one another by said sound absorbing material.

14. A silencer for a suction cleaner comprising a unitary member of sound absorbing material having first and second opposing sides and an axis, said member having a central opening for receiving a motor of the suction cleaner and a plurality of substantially straight flow passages aligned in a direction parallel to the axis, said central opening and said plurality of flow passages having respective lengths that extend from said first side to said second side, each of said plurality of flow passages being partitioned from one another and from the central opening by said sound absorbing material.

15. A silencer according to claim 14, wherein each of said plurality of flow passages is elongate and has a width within a range of 4 mm to 8 mm.

16. A silencer according to claim 15, wherein each of the flow passages has a V-shape.

* * * * *